US005457013A

United States Patent [19]

Christian et al.

[11] Patent Number: 5,457,013

[45] **Date of Patent: * Oct. 10, 1995**

[54] IMAGING ELEMENT COMPRISING A TRANSPARENT MAGNETIC LAYER AND AN ELECTRICALLY-CONDUCTIVE LAYER CONTAINING PARTICLES OF A METAL ANTIMONATE

[75] Inventors: Paul A. Christian, Pittsford; Charles C. Anderson, Penfield, both of N.Y.

[73] Assignee: Eastman Kodak Company, Rochester, N.Y.

[ * ] Notice: The portion of the term of this patent subsequent to Nov. 29, 2011, has been disclaimed.

[21] Appl. No.: 324,811

[22] Filed: Oct. 17, 1994

Related U.S. Application Data

[63] Continuation-in-part of Ser. No. 231,218, Apr. 22, 1994, Pat. No. 5,368,995.

[51] Int. Cl.[6] ..... G03C 1/85; G03C 1/76

[52] U.S. Cl. ..... 430/496

[58] Field of Search ..... 430/140, 523, 430/530, 496, 501

[56] References Cited

U.S. PATENT DOCUMENTS

| | | | |
|---|---|---|---|
| 4,110,247 | 8/1978 | Gower et al. | 252/313.1 |
| 4,169,104 | 9/1979 | Burt et al. | 556/30 |
| 4,275,103 | 6/1981 | Tsubusaki et al. | 428/148 |
| 4,394,441 | 7/1983 | Kawaguchi et al. | 430/524 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,990,276 | 2/1991 | Bishop et al. | 252/62.54 |
| 4,999,276 | 3/1991 | Kuwabara et al. | 430/264 |
| 5,122,445 | 6/1992 | Ishigaki | 430/523 |
| 5,252,441 | 10/1993 | James et al. | 430/496 |
| 5,254,449 | 10/1993 | James et al. | 430/533 |
| 5,368,995 | 11/1994 | Christian et al. | 430/530 |

OTHER PUBLICATIONS

Research Disclosure 34,390, Nov., 1992.

*Primary Examiner*—Charles L. Bowers, Jr.
*Assistant Examiner*—Mark F. Huff
*Attorney, Agent, or Firm*—Alfred P. Lorenzo

[57] ABSTRACT

Imaging elements, such as photographic, electrostatographic and thermal imaging elements, are comprised of a support, an image-forming layer, a transparent magnetic layer comprising magnetic particles dispersed in a film-forming binder and an electrically-conductive layer comprising a dispersion in a film-forming binder of fine particles of an electronically-conductive metal antimonate. Use of metal antimonate particles provides a controlled degree of electrical conductivity and beneficial chemical, physical and optical properties which adapt the electrically-conductive layer for such purposes as providing protection against static or serving as an electrode which takes part in an image-forming process.

26 Claims, No Drawings

IMAGING ELEMENT COMPRISING A TRANSPARENT MAGNETIC LAYER AND AN ELECTRICALLY-CONDUCTIVE LAYER CONTAINING PARTICLES OF A METAL ANTIMONATE

CROSS-REFERENCE TO RELATED APPLICATIONS

This application is a continuation-in-part of U.S. patent application Ser. No. 231,218, filed Apr. 22, 1994, "Imaging Element Comprising An Electrically Conductive Layer Containing Particles Of A Metal Antimonate" by Paul A. Christian and Charles C. Anderson and issued Nov. 29, 1994, as U.S. Pat. No. 5,368,995.

FIELD OF THE INVENTION

This invention relates in general to imaging elements, such as photographic, electrostatographic and thermal imaging elements, and in particular to imaging elements comprising a support, an image-forming layer, a transparent magnetic layer, and an electrically-conductive layer. More specifically, this invention relates to electrically-conductive layers containing electronically-conductive particles and to the use of such electrically-conductive layers in imaging elements for such purposes as providing protection against the generation of static electrical charges or serving as an electrode which takes part in an image-forming process. The imaging elements include a transparent magnetic layer as well as an electrically-conductive layer so as to provide enhanced performance characteristics.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers.

An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistivity of $10^2$ to $10^{11}$ ohms per square . The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $Ir_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ohms per square for antistatic layers containing the preferred metal oxides. In order to obtain high electrical conductivity, a relatively large amount (0.1–10 g/$m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive particles in an electro-conductive coating to achieve effective antistatic performance can result in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

It is well known to include in imaging elements a transparent layer containing magnetic particles dispersed in a binder. Transparent magnetic layers and their use in photographic elements are described, for example, in U.S. Pat. Nos. 3,782,947, 4,279,945, 4,302,523, 4,990,276, 5,217,804, 5,252,441 and 5,254,449, in European Patent Application No. 0 459 349, published Dec. 4, 1991, and in *Research Disclosure*, Item 34390, November, 1992. However, to provide both effective magnetic properties and effective electrical conductivity characteristics in an imaging element, without impairing its imaging characteristics, poses considerable technical difficulty.

It is toward the objective of providing both magnetic layers and electrically-conductive layers that more effectively meet the diverse needs of imaging elements—especially of silver halide photographic films but also of a wide range of other imaging elements—than those of the prior art that the present invention is directed.

SUMMARY OF THE INVENTION

The present invention pertains to imaging elements which exhibit excellent magnetic performance as well as having a high degree of electrical conductivity. More specifically, the present invention pertains to an imaging element for use in an image-forming process which comprises a support, an image-forming layer, a transparent magnetic layer comprising magnetic particles dispersed in a film-forming binder, and an electrically-conductive layer comprising a dispersion in a film-forming binder of fine particles of an electronically-conductive metal antimonate. Preferably, the transparent magnetic layer provides a coverage of magnetic particles in the range of from about 0,001 g/m$^2$ to about 10 g/m$^2$, and more preferably in the range of from about 0.01 g/m$^2$ to about 1 g/m$^2$.

The imaging elements of this invention can contain one or more image-forming layers, one or more transparent magnetic layers, and one or more electrically-conductive layers and such layers can be coated on any of a very wide variety of supports. Use of an electronically-conductive metal antimonate dispersed in a suitable film-forming binder enables the preparation of a thin, highly conductive, transparent layer which is strongly adherent to photographic supports as well as to overlying layers such as emulsion layers, pelloids, topcoats, backcoats, and the like. The electrical conductivity provided by the conductive layer of this invention is independent of relative humidity and persists even after exposure to aqueous solutions with a wide range of pH values (i.e., $2 \leqq pH \leqq 13$) such as are encountered in the processing of photographic elements.

The transparent magnetic layer can be positioned in an imaging element in any of various positions. For example, it can overlie one or more image-forming layers, or underlie one or more image-forming layers, or be interposed between image-forming layers, or serve as a subbing layer for an image-forming layer, or be coated on the side of the support opposite to the image-forming layer. A typical thickness for the transparent magnetic layer in the imaging elements of this invention is in the range of from about 0.05 to about 10 micrometers. Use, in combination with an electrically-conductive layer containing fine particles of an electronically-conductive metal antimonate, of a transparent magnetic layer in which the magnetic particles are cobalt-modified γ-iron oxide particles provides particularly excellent performance.

In a particular embodiment of this invention, the transparent magnetic layer is formed from a dispersion comprising magnetic particles, a dialkyl ester of phthalic acid and a dispersing agent as described in Bishop et al, U.S. Pat. No. 4,990,276, issued Feb. 5, 1991.

In a further particular embodiment of this invention, the transparent magnetic layer is formed from magnetic particles which are cobalt surface treated gamma iron oxide particles having a specific surface area of at least 30 m$^2$/g and a powder coercivity of greater than about 450 Oe and being coated with from about 10 to about 50% by weight of a material having a refractive index less than that of the binder as described in James et al, U.S. Pat. No. 5,252,441, issued Oct. 12, 1993.

Imaging elements in accordance with this invention can be advantageously prepared by use of the process described in James et al, U.S. Pat. No. 5,254,449, issued Oct. 19, 1993, in which a magnetic dispersion is co-cast with a cellulose organic acid ester solution.

For use in imaging elements, the average particle size of the electronically-conductive metal antimonate is preferably less than about one micrometer and more preferably less than about 0.5 micrometers. For use in imaging elements where a high degree of transparency is important, it is preferred to use colloidal particles of an electronically-conductive metal antimonate, which typically have an average particle size in the range of 0.01 to 0.05 micrometers.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic-vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure*, June 1978, Item No. 17029; U.S. Pat. Nos. 3,457,075; 3,933,508; and 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal*, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography*, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include at least one electrically-conductive layer comprising a dispersion in a film-forming binder of fine particles of an electronically-conductive metal antimonate.

Metal antimonates which are preferred for use in this invention have rutile or rutile-related crystallographic structures and are represented by either Formula (I) or Formula (II) below:

$$M^{+2}Sb^{+5}{}_2O_6 \quad \text{(I)}$$

where $M^{+2}$ =$Zn^{+2}$, $Ni^{+2}$, $Mg^{+2}$, $Fe^{+2}$, $Cu^{+2}$, $Mn^{+2}$, $Co^{+2}$ $$M^{+3}Sb^{+5}O_4 \quad \text{(II)}$$

where $M^{+3}$ =$In^{+3}$, $Al^{+3}$, $Sc^{+3}$, $Cr^{+3}$, $Fe^{+3}$, $Ga^{+3}$.

Several colloidal conductive metal antimonates are commercially available from Nissan Chemical Industries Ltd. in the form of dispersions in water or in organic solvents. (See published Japanese Patent Application No. 6-219743.) Alternatively, U.S. Pat. Nos. 4,169,104 and 4,110,247 teach a method for preparing compound I ($M^{+2}$=$Zn^{+2}$, $Ni^{+2}$, $Cu^{+2}$, $Fe^{+2}$, etc.) by treating an aqueous solution of potassium antimonate (i.e., $KSb(OH)_6$) with an aqueous solution of an appropriate soluble metal salt (e.g., chloride, nitrate, sulfate, etc.) to form a gelatinous precipitate of the corresponding insoluble hydrate of compound I. The isolated hydrated gels are then washed with water to remove the excess potassium ions and salt anions. The washed gels are peptized by treatment with an aqueous solution of organic base (e.g., triethanolamine, tripropanolamine, diethanolamine, monoethanolamine, quaternary ammonium hydroxides, etc.) at temperatures of 25° to 150° C. as taught in U.S. Pat. No. 4,589,997 for the preparation of colloidal antimony pentoxide sols. Other methods used to prepare colloidal sols of metal antimony oxide compounds have been reported. A sol-gel process has been described by Westin and Nygren (*J. Mater. Sci.*, 27, 1617–25 (1992); *J. Mater. Chem.*, 3, 367–71 (1993) in which precursors of I comprising binary alkoxide complexes of antimony and a bivalent metal are hydrolyzed to give amorphous gels of agglomerated colloidal particles of hydrated I. Heat treatment of such hydrated gels at moderate temperatures (<800° C.) is reported to form anhydrous particles of I of the same size as the colloidal particles in the gels. Further, a colloidal compound I prepared by such methods can be made conductive through appropriate thermal treatment in a reducing or inert atmosphere. A ceramic method used to prepare conductive metal antimony oxide compound II ($M^{+3}$=$In^{+3}$, $Sc^{+3}$) is disclosed in U.S. Pat. No. 3,449,064.

In order to be suitable for use in antistatic coatings for critical photographic applications, the conductive metal antimonates must have a small average particle size. Small particle size minimizes light scattering which would result in reduced optical transparency of the coating. The relationship between the size of a particle, the ratio of its refractive index to that of the medium in which it is incorporated, the wavelength of the incident light, and the light scattering efficiency of the particle is described by Mie scattering theory (*G. Mie, Ann, Physik.*, 25, 377 (1908). A discussion of this topic as it is relevant to photographic applications has been presented by T. H. James ("The Theory of the Photographic Process", 4th ed., Rochester: EKC, 1977). In the case of electroconductive particles of formula I or II coated in a thin layer using a typical photographic gelatin binder system, it is necessary to use powders with an average particle size less than about 0.2 μm in order to limit the scattering of light at a wavelength of 550 nm to less than 20%. For shorter wavelength light, such as the ultraviolet light used to expose some daylight-insensitive graphic arts films, electroconductive particles with an average size much less than about 0.1 μm are preferred.

In addition to the optical requirements, a very small average particle size is needed to ensure that even in thin coatings there is a multiplicity of interconnected chains or networks of conductive particles which afford multiple electrically-conductive pathways through the layer and result in electrical continuity. The very small average particle size of conductive colloidal metal antimonates (typically 0.01– 0.05 μm) results in multiple conductive pathways in the thin antistatic layers of the present invention.

In the case of other commercially available conductive metal oxide pigments, the average particle size (typically 0.5–0.9 μm) can be reduced by various mechanical milling processes well known in the art of pigment dispersion and paint making. However, most of these metal oxide pigments are not sufficiently chemically homogeneous to permit size reduction by attrition to the colloidal size required to ensure both optical transparency and multiple conductive pathways in thin coatings and still retain sufficient inter-particle conductivity to be useful in an antistatic layer.

Binders useful in antistatic layers containing conductive metal antimonate particles include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes or polyesterionomers.

Solvents useful for preparing coatings of conductive metal antimonate particles include: water, alcohols such as methanol, ethanol, propanol, isopropanol; ketones such as acetone, methylethyl ketone, and methylisobutyl ketone; esters such as methyl acetate, and ethyl acetate; glycol ethers such as 2-methoxyethanol, 2-ethoxyethanol, 1-methoxy-2-propanol; and mixtures thereof.

In addition to binders and solvents, other components that are well known in the photographic art may also be present in the electrically-conductive layer. These additional components include: surfactants (including fluorinated surfactants), dispersing aids, coating aids, thickeners, crosslinking agents or hardeners, soluble and/or solid particle dyes, antifoggants, matte particles, lubricants, and others.

The ratio of the amount of the particles of metal antimonate to the binder in the dispersion is one of the important factors which influence the ultimate conductivity achieved by the coated layer. If this ratio is small, little or no antistatic property is exhibited. If this ratio is very large, adhesion between the conductive layer and the support or overlying layers can be diminished. The optimum ratio of conductive particles to binder varies depending on the particle size, binder type, and conductivity requirements. The volume fraction of conductive metal antimonate particles is preferably in the range of from about 20 to 80% of the volume of the coated layer. The dry coated weight of the conductive layer is preferably in the range of from about 0.1 to about 10 $g/m^2$. The concentration of conductive metal antimonate present in the coated layer will vary depending on the weight density of the particular compound used.

Dispersions of conductive metal antimonate particles formulated with binder and additives can be coated onto a variety of photographic supports. Suitable film supports include polyethylene terephthalate, polyethylene naphthalate, polycarbonate, polystyrene, cellulose nitrate, cellulose acetate, cellulose acetate butyrate, cellulose acetate propionate, and laminates thereof. Film supports can be either transparent or opaque depending on the application. Transparent film supports can be either colorless or colored by the addition of a dye or pigment. Film supports can be surface treated by various processes including corona discharge, glow discharge, UV exposure, solvent washing or overcoated with polymers such as vinylidene chloride containing copolymers, butadiene-based copolymers, glycidyl acrylate or methacrylate containing copolymers, or maleic anhydride containing copolymers. Suitable paper supports include polyethylene-, polypropylene-, and ethylene-butylene copolymer-coated or laminated paper and synthetic papers.

The formulated dispersions can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating.

The antistatic layer or layers containing the conductive metal antimonate particles can be applied to the support in various configurations depending upon the requirements of the specific application. In the case of photographic elements for graphics arts application, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The antistatic layer would typically be located closest to the support. An intermediate layer, containing primarily binder and antihalation dyes functions as an antihalation layer. The outermost layer containing binder, matte, and surfactants functions as a protective overcoat. Other addenda, such as polymer lattices to improve dimensional stability, hardeners or crosslinking agents, and various other conventional additives as well as conductive metal antimonate particles can be present optionally in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

The conductive layer of this invention may also be used as the outermost layer of an imaging element, for example, as the protective overcoat that overlies a photographic emulsion layer. Alternatively, the conductive layer can function as an abrasion-resistant backing layer applied on the side of the film support opposite to the imaging layer. The conductive layer can also be interposed between image-forming layers.

As indicated hereinabove, transparent magnetic layers are well known in the art and are described in numerous references such as U.S. Pat. Nos. 3,782,947, 4,279,945, 4,302,523, 4,990,276, 5,217,804, 5,252,441, 5,254,449, European Patent Application No. 0 459 349 and *Research Disclosure*, Item 34390, November, 1992, the disclosures of which are incorporated herein by reference. As disclosed in these publications, the magnetic particles can consist of ferro- or ferrimagnetic oxides, complex oxides including other metals, metallic alloy particles with protective coatings, ferrites, hexaferrites, etc. and can exhibit a variety of particulate shapes, sizes, and aspect ratios. The magnetic particles optionally can contain a variety of dopants and can be overcoated with a shell of particulate or polymeric material. The conductive layer can be located beneath the magnetic layer as a subbing layer, overlying the magnetic layer as a backcoat or can be on the opposite side of the support from the magnetic layer underlying an emulsion layer or a layer containing antihalation dyes or pigments as a subbing layer or overlying an emulsion layer as a topcoat. The location of the conductive layer is not limited to the specific configurations described herein. Additional functional layers may be present including but not limited to abrasion resistant and other protective layers, abrasive-containing layers, adhesion-promoting layers, lubricant layers, and other magnetic layers for purposes such as improving web conveyance, optical properties, physical performance, and durability.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove.

The present invention is further illustrated by the following examples of its practice.

Example 1

An antistatic coating formulation comprising colloidal conductive particles with average particle size of about 0.01 to 0.05 μm (by TEM) of metal antimonate compound I ($M^{+2}=Zn^{+2}$), gelatin, and various additives described below was applied, using a coating hopper, to a moving web of 0.1 millimeter thick polyethylene terephthalate film support that had been previously undercoated with a terpolymer latex of acrylonitrile, vinylidene chloride, and acrylic acid. The weight percent composition of the aqueous coating formulation is listed below:

| Component | Weight % (dry) | Weight % (wet) |
|---|---|---|
| colloidal $ZnSb_2O_6$ | 88.8 | 1.8 |
| binder (gelatin) | 9.9 | 0.2 |
| hardener (dihydroxy-dioxane) | 0.3 | 0.006 |
| wetting aid (Olin 10G) | 0.5 | 0.01 |
| silica matte | 0.5 | 0.01 |
| water | 0.0 | (balance) |

The antistatic subbing layer was coated at a dry coverage of 0.3 g/m$^2$ (total solids) which corresponds to a wet coating laydown of ~12 cm$^3$/m$^2$. The surface resistivity (SER) of the antistatic layer was measured at both nominally 50% R.H. and after conditioning for 48 hrs at 20% R.H. using a two-point probe method. (See, for example, U.S. Pat. No. 2,801,191.) The SER values measured are reported in Table 1 below. Optical and UV densities of the antistatic layer were both measured using a X-Rite Model 361T densitometer. These measured values are also reported in Table 1.

The antistatic layer described above is just as conductive at 20% R.H. as it is at 50% R.H. The optical and UV densities are nearly identical to those of the uncoated support. The antistatic layer of this example is strongly adherent to the subbed support. Further, the antistatic property of the conductive layer of this example was not diminished at all by processing with commercial photographic processing solutions such as KODAK ULTRATEC developing solution. The SER value measured after processing is given in Table 1.

Example 2

An antistatic coating formulation comprising colloidal conductive particles with an average particle size of about 0.01 to 0.05 μm (by TEM) of metal antimonate compound II ($M^{+3}=In^{+3}$) substituted for metal antimonate compound I ($M^{+2}=Zn^{+2}$), gelatin, and varous other additives in the same relative amounts as in Example 1 was prepared. This coating formulation was coated in the identical manner as used to prepare the antistatic layer of Example 1.

The surface resistivity (SER) of the resulting antistatic layer was measured at nominally 50% R.H. and after conditioning for 48 hours at 20% R.H. using a two-point probe as in Example 1. The optical and UV densities were measured as in Example 1. The SER values and optical and UV densities are reported in Table 1. The antistatic layer was also subjected to processing using commercial solutions as in Example 1. The SER value measured after processing at 50% R.H. (nominal) is given in Table 1.

The substitution of colloidal conductive particles of the metal antimonate compound II ($M^{+3}=In^{+3}$) for I ($M^{+2}=Zn^{+2}$) in the coating formulation also results in a transparent, highly conductive, adherent, and permanent antistatic layer for use on photographic film support.

Examples 3–6

Antistatic coating formulations comprising colloidal conductive particles of either metal antimonate compounds I (M=Zn) or II (M=In), polyvinylbutyral as binder, isopropanol as solvent, and other additives in the same relative amounts as in Example 1 were prepared. The colloidal metal antimonate particles were added as nominally 20% (w/w) dispersions in methanol. The polyvinylbutyral binder was added as a 10% solution in isopropanol. Isopropanol was substituted for water as the primary solvent. The two coating solutions each were coated at dry coverages of 0.5 g/m$^2$ and 0.25 g/m$^2$ The surface resistivities of the four antistatic layers were measured at both nominally 50% R.H. and after conditioning for 48 hours at 20% R.H. as in Example 1. The SER values are given in Table 2. Optical and UV densities of the coated layers were also measured and are reported in Table 2.

Examples 3–6 demonstrate that it is possible to prepare transparent antistatic layers using a colloidal dispersion of either metal antimonate compound I or II in a solvent-based coating formulation with a nonaqueous binder system. The antistatic layers of these examples are nearly as conductive as those prepared in Examples 1 and 2. Additionally, these antistatic layers are suitable for use as abrasion-resistant conductive backing layers for photographic imaging elements.

TABLE 1

| Example | Resistivity (logΩ/square) 50% R.H. | 20% R.H. | Density ($D_{min}$) UV | Optical |
|---|---|---|---|---|
| 1 | 7.6 | 8.1 | 0.040 | 0.020 |
| 1(post-processing) | 7.5 | — | — | — |
| 2 | 8.2 | 8.1 | 0.040 | 0.023 |
| 2(post-processing) | 7.9 | — | — | — |
| Subbed support | >13 | >13 | 0.027 | 0.017 |

TABLE 2

| Example No. | Metal Antimonate | Total Dry Coverage (g/m$^2$) | Binder | Resistivity (logΩ/square) 50% RH | 20% RH | Density($D_{min}$) UV | Optical |
|---|---|---|---|---|---|---|---|
| 1 | $ZnSb_2O_6$ | 0.3 | B-1 | 7.6 | 8.1 | 0.040 | 0.020 |
| 2 | $InSbO_4$ | 0.3 | B-1 | 8.2 | 8.1 | 0.040 | 0.023 |
| 3 | $ZnSb_2O_6$ | 0.5 | B-2 | 8.5 | 9.2 | 0.070 | 0.027 |
| 4 | $InSbO_4$ | 0.5 | B-2 | 8.0 | 8.2 | 0.066 | 0.030 |
| 5 | $ZnSb_2O_6$ | 0.25 | B-2 | 9.0 | 9.7 | 0.059 | 0.023 |
| 6 | $InSbO_4$ | 0.25 | B-2 | 9.0 | 9.2 | 0.052 | 0.022 |
| 7 | $InSbO_4$ | 0.25 | B-3 | 8.9 | 8.8 | 0.063 | 0.025 |

Notes
B-1 = gelatin
B-2 = polyvinylbutyral
B-3 = vinylidene chloride-based terpolymer latex

Example 7

An antistatic coating formulation comprising colloidal conductive particles of metal antimonate compound II ($M^{+3}$=$In^{+3}$), a vinylidene chloride based terpolymer latex as binder, and other additives was prepared as in Example 1. The weight percent composition of the aqueous coating formulation is listed below:

| Component | Weight % (dry) | Weight % (wet) |
|---|---|---|
| colloidal $InSbO_4$ | 75 | 0.78 |
| binder (terpolymer latex) | 24 | 0.26 |
| wetting aid (Olin 10G) | 0.5 | 0.005 |
| silica matte | 0.5 | 0.005 |
| water | 0 | (balance) |

The coating formulation of this example was coated at a nominal coverage of 0.25 g/m$^2$. The surface resistivity of the coated layer was measured at both nominally 50% R.H. and after conditioning for 48 hours at 20% R.H. as in Example 1. The SER values are given in Table 2. Optical and UV densities of the coated layer were also measured and are reported in Table 2. Even at a lower conductive metal antimonate II (M=In) content (75%) in the coated layer than in Example 6, the antistatic layer of this example is just as conductive. This example demonstrates that other aqueous polymeric binder systems besides gelatin are suitable for preparing transparent, conductive layers on photographic film support.

Example 8

The electrically-conductive antistatic subbing layer of Example 1 was overcoated with a hydrophilic curl-control layer comprising gelatin, bisvinylmethane sulfone hardener, water-soluble anionic cyan and yellow filter dyes, polymeric matte, and Olin 10G surfactant as a coating aid. The hydrophilic curl-control layer was coated at a dry coverage of 4 g/m$^2$ (total solids). The resistivity of the overcoated antistatic layer was measured by the salt bridge method (see, for example, "Resistivity Measurements On Buried Conductive Layers" by R. A. Elder, pages 251–254, 1990 EOS/ESD Symposium Proceedings) both before and after processing with commercial photographic processing solutions such as KODAK ULTRATEC developing solution. These measured values are reported in Table 3.

A test sample of the coating of this Example was also evaluated for adhesion of the gelatin curl-control layer to the antistatic subbing layer. Dry adhesion was evaluated by scribing a small crosshatched region into the coating with a razor blade, placing a piece of high tack adhesive tape over the scribed area, and then quickly stripping the tape from the surface. The relative amount of material removed from the scribed area is a qualitative measure of dry adhesion. Wet adhesion was also evaluated. A sample of the coating of this Example was placed into developing and fixing solutions at 35° C. for 30 seconds each, rinsed in distilled water, and while still wet, a one millimeter wide line was scribed into the curl-control layer. The scribed line was rubbed vigorously with a finger in a direction perpendicular to the line. The relative width of the line after rubbing compared to that before rubbing is a qualitative measure of wet adhesion. The results of these evaluations are reported in Table 3.

Example 9

The electrically-conductive antistatic subbing layer of Example 2 was overcoated with a hydrophilic curl-control layer in a manner identical to that described in Example 8. The resistivity of the overcoated antistatic layer was measured by the salt bridge method both before and after processing in commercial photographic processing solutions. These measured resistivity values are reported in Table 3. The wet and dry adhesion of the curl control layer to the antistatic layer were evaluated in a manner identical to that described in Example 8. The results of these evaluations are also reported in Table 3.

TABLE 3

| Example | Resistivity (logΩ/square) | | Coating Adhesion | |
|---|---|---|---|---|
| No. | Initial | Post-Processing | Dry | Wet |
| 8 | 7.65 | 7.15 | excellent | excellent |
| 9 | 8.15 | 7.30 | excellent | excellent |

Example 10

Electrically-conductive antistatic subbing layers containing colloidal particles of metal antimonate compounds I ($M^{+2}=Zn^{+2}$) and II ($M^{+3}=In^{+3}$) were prepared in the manner described in Example 1 at nominal dry coverages of 0.25, 0.35, and 0.45 g/m$^2$ (total solids). The nominal weight ratio of the metal antimonate to gelatin was 85:15 rather than 90:10 as in Example 1. The weight percent composition of the aqueous coating formulation used to prepared the antistatic layers of the present example is listed below:

| Component | Weight (dry) | Weight % (wet) |
|---|---|---|
| $ZnSb_2O_6$ or $InSbO_4$ sol | 83.5 | 1.7 |
| binder (gelatin) | 14.7 | 0.3 |
| hardener[1] | 0.3 | 0.006 |
| wetting aid[2] | 1.5 | 0.03 |
| water | 0.0 | (balance) |

[1]2,3-dihydroxy-1,4-dioxane

[2]A para-isononylphenoxy polyglycidol available from Olin Mathieson Corporation under the trademark SURFACTANT 10G.

The electrically-conductive layers were overcoated with a transparent magnetic layer as described in *Research Disclosure*, Item 34390, November, 1991. The transparent magnetic layer comprised a dispersion of cobalt-modified y-iron oxide particles in a polymeric binder with an optional crosslinker. Total dry coverage for the magnetic layer was nominally about 1.50 g/m$^2$. An optional lubricant-containing layer comprising carnauba wax and a fluorinated surfactant as a wetting aid was coated on top of the transparent magnetic layer at a nominal dry coverage of about 0.02 g/m$^2$.

The surface resistivities (SER) of antistatic layers coated at the three dry coverages were measured at 50% R.H. prior to overcoating with transparent magnetic layers and optional lubricant layers. The values obtained are listed in Table 4. The internal resistivities of the antistatic layers after overcoating with a transparent magnetic layer and an optional lubricant layer were measured and the values reported in Table 4. The internal resistivities of antistatic layers overcoated with magnetic and lubricant layers also were measured after processing with commercial photographic processing solutions by the standard KODAK C-41 process. The values obtained are shown in Table 4.

Optical (ortho) and UV densities for the antistatic layers overcoated with magnetic and lubricant layers were measured and the values listed in Table 4. The values for the optical and UV densities for the magnetic layer coated directly onto an undercoated support without an underlying antistatic layer were 0.073 and 0.199, respectively. The dry adhesion of test samples of antistatic layers overcoated with magnetic and lubricant layers was evaluated in the manner described in Example 8. The results of these evaluations are reported in Table 4.

TABLE 4

| Ex. | | Tot Dry Coverage | Resistivity (logΩ/□) Surf | Internal(WER) | | Density($D_{min}$) | | Dry |
|---|---|---|---|---|---|---|---|---|
| No. | Cpd | (g/m$^2$) | (SER) | Initl | Post-Proc | UV | Ortho | Adhesion |
| 10a | $ZnSb_2O_6$ | 0.25 | 8.6 | 8.9 | 9.1 | 0.220 | 0.082 | excellent |
| 10b | " | 0.35 | 8.0 | 8.3 | 8.3 | 0.233 | 0.082 | excellent |
| 10c | " | 0.45 | 7.7 | 8.1 | 8.2 | 0.242 | 0.086 | excellent |
| 10d | $InSbO_4$ | 0.25 | 10.3 | 9.4 | 9.4 | 0.218 | 0.083 | excellent |
| 10e | " | 0.35 | 9.5 | 8.4 | 8.2 | 0.225 | 0.085 | excellent |
| 10f | " | 0.45 | 8.0 | 8.1 | 8.1 | 0.229 | 0.086 | excellent |

Examples 10a–f demonstrate that antistatic performance of layers containing colloidal particles of metal antimonate compounds I ($M^{+2}=Zn^{+2}$) or II ($M^{+3}=In^{+3}$) is not compromised appreciably by overcoating with magnetic and lubricant layers. Furthermore, the antistatic performance of the overcoated antistatic layer is not affected by photographic processing. There is little or no apparent increase in optical or UV densities of the antistatic layers as a consequence of overcoating with magnetic and lubricant layers other than that associated with the magnetic layer. In addition to the excellent dry adhesion of the antistatic layer to the support as described in Examples 8 and 9, the antistatic layers of Examples 10a–f also exhibited excellent dry adhesion to the overlying magnetic layer.

A sample length of the coating of Example 10c was subjected to a durability test procedure. The test procedure comprised recording a test signal in the magnetic layer of an appropriate length of the sample coating and subjecting the coating to a reciprocating bidirectional motion across a magnetic read head. The raw (peak-to-peak) amplitude and pulse width of the recorded signal were monitored as a function of cycle number. A performance failure in this test is denoted by substantial loss in amplitude or broadening of the pulse of the recorded signal prior to the completion of 250 bidirectional read cycles. The sample coating of Example 10c showed no evidence of signal degradation after 600 bidirectional read cycles. This result clearly demonstrates that the durability and magnetic performance of the magnetic layer can be maintained in the presence of an underlying antistatic layer, Further, the excellent adhesion of the underlying antistatic layer to the magnetic layer and the physical integrity of the backing layer structure is evidenced by this Example.

Example 11

Electrically-conductive antistatic subbing layers containing metal antimonate compound I ($M^{+2}=Zn^{+2}$) and a vinylidene chloride-based terpolymer latex as binder were prepared in a manner similar to that described in Example 7 with metal antimonate compound I ($M^{+2}=Zn^{+2}$) substituted for metal antimonate compound II ($M^{+3}=In^{+3}$). The weight percent composition of the aqueous coating formulation used to prepare the antistatic layers of the present example is listed below:

| Component | Weight % (dry) | Weight % (wet) |
|---|---|---|
| colloidal $ZnSb_2O_6$ | 74 | 1.20 |
| binder (terpolymer latex) | 24.7 | 0.40 |
| dispersing aid[1] | 0.7 | 0.012 |
| wetting aid (Surfactant 10G) | 0.6 | 0.010 |
| water | 0 | (balance) |

[1]A sodium salt of a polymeric carboxylic acid available from Allied Colloids, Inc. under the trademark DISPEX N40.

The coating solution of the present example was coated at nominal dry coverages of 0.5 and 0.65 g/m$^2$ (total solids). The surface resistivities of the coated antistatic layers were measured at nominally 50% R.H. and the values obtained listed in Table 5. Optical and UV densities of the antistatic layers prior to overcoating with magnetic layers were measured and the values listed in Table 5. The antistatic layers were overcoated with a transparent magnetic layer as described in Example 10. The internal resistivities of the antistatic layers after overcoating with magnetic layers were measured by the salt bridge method (WER). The measured values are reported in Table 5. Optical and UV densities of the antistatic layers overcoated with magnetic layers were measured and the values listed in Table 5.

The antistatic layers of the present example demonstrate that conductive layers can be prepared at a 75:25 weight ratio of metal antimonate to binder and still remain conductive after overcoating with a magnetic layer.

TABLE 5

| Example No. | Total Dry Coverage (g/m$^2$) | Resist. (logΩ/□) Surface (SER) | Resist. (logΩ/□) Internal (WER) | Density ($D_{min}$) w/o magnetic UV | Density ($D_{min}$) w/o magnetic Ortho | Density ($D_{min}$) w/magnetic UV | Density ($D_{min}$) w/magnetic Ortho |
|---|---|---|---|---|---|---|---|
| 11a | 0.5 | 8.1 | 11.1 | 0.091 | 0.029 | 0.290 | 0.102 |
| 11b | 0.65 | 8.0 | 9.7 | 0.108 | 0.032 | 0.307 | 0.105 |

Example 12

Electrically-conductive antistatic subbing layers containing colloidal particles of metal antimonate compound II ($M^{+3}=In^{+3}$) were prepared in the general manner described in Example 2. In the present example, polymethylmethacrylate (available from E. I. DuPont de Nemours and Company under the trademark ELVACITE 2010) was used as the binder in place of gelatin. The polymethylmethacrylate binder was added as a 6% (w/w) solution in methylethylketone. The colloidal metal antimonate particles were added as a 20% (w/w) dispersion in methanol. A 50:50 (w/w) mixture of methylethylketone / methanol was used as the primary coating solvent in place of the water used in Example 2. Various dispersing aids, wetting aids or surfactants, including fluorinated surfactants, and resorcinol (adhesion promoting additive) were included in the coating solution. The weight percent composition of the solvent coating formulation is listed below:

| Component | Weight % (dry) | Weight % (wet) |
|---|---|---|
| colloidal $InSbO_4$ | 79.0 | 1.16 |
| binder (ELVACITE 2010) | 14.3 | 0.21 |
| dispersing aid | 0.8 | 0.012 |
| wetting aid[1] | 1.2 | 0.018 |
| resorcinol | 4.7 | 0.069 |
| solvent(s) | 0 | (balance) |

[1]A nonionic fluorinated alkyl ester available from Minnesota Mining and Manufacturing Company under the trademark FLUORAD FC-431.

The coating solution was coated to give a total dry coverage of 0.65 g/m$^2$ onto polyethylene terephthalate film support that had been previously undercoated with a terpolmer latex of acrylonitrile, vinylidene chloride, and acrylic acid.

The surface resistivity (SER) of the conductive layer was measured: 8.80 log Ω/□. After overcoating the conductive layer with a magnetic layer as described in Example 10, the internal resistivity (WER) was measured: 8.50 log Ω/□. The present example demonstrates that the antistatic performance of a conductive layer containing colloidal metal antimonate with a solvent-based binder system is undiminished by overcoating with a magnetic layer. Further, the antistatic performance of the overcoated antistatic layer is not affected by photographic processing as demonstrated by the internal resistivity (WER) after processing: 8.4 log Ω/□. As was the case for Example 10, the dry adhesion of the magnetic layer to the antistatic layer was excellent.

Example 13

A transparent magnetic layer as described in Example 10 was coated onto a polyethylene terephthalate support which had been previously undercoated with a terpolymer latex of acrylonitrile, vinylidene chloride, and acrylic acid. The nominal total dry coverage of the magnetic layer was 1.5 g/m$^2$. All antistatic coating formulation containing colloidal metal antimonate compound I ($M^{+2}=Zn^{+2}$) similar to that described in Example 10 was applied on top of the magnetic layer at several different dry coverages.

The surface resistivities of the topically applied antistatic layers were measured and the results listed in Table 6. The optical and UV densities were also measured for the topically applied antistatic layers. The measured values were corrected for the densities of the magnetic layer and the undercoated PET support and are reported in Table 6 as "delta" densities. These values can be compared directly with those measured for the antistatic layers of Examples 1 and 11 alone prior to overcoating with magnetic layers. Examples 13a–c clearly demonstrate that an aqueous coating formulation containing colloidal metal antimonate particles with gelatin as a binder can be coated over a magnetic layer containing a different binder system to give an antistatic layer which adheres to the magnetic layer and is highly conductive and transparent.

TABLE 6

| Example No. | Total Dry Coverage ($g/m^2$) | Resistivity (logΩ/□) Surface (SER) | Delta Density ($D_{min}$) UV | Delta Density ($D_{min}$) Ortho |
|---|---|---|---|---|
| 13a | 0.25 | 7.6 | 0.068 | 0.021 |
| 13b | 0.45 | 7.2 | 0.092 | 0.023 |
| 13c | 0.65 | 7.3 | 0.101 | 0.026 |

The basic magnetic performance of the magnetic layers overcoated with antistatic layers was evaluated by measuring the magnetic hysteretic properties using a BH loop tracer (LDJ Model 7500A). Coercivity, magnetization, and squareness ratio were measured for each of Examples 13a–c and compared with the values obtained for a magnetic layer alone. No significant differences were observed. These results demonstrate that the integrity of the magnetic layer was maintained after overcoating with the conductive layer.

Example 14

Antistatic solvent-based coating formulations similar to that described in Example 12 were applied at various total dry coverages to a support that had been previously coated with a transparent magnetic layer. Colloidal metal antimonate compound I ($M^{+2}$=$Zn^{+2}$) or compound II ($M^{+3}$=$In^{+3}$) was introduced into the coating solution as a 20% (w/w) dispersion in methanol. The binder was a hydroxyethyl cellulose which was 48% ethoxylated and introduced as a nominal 2% (w/w) solution in methanol/glycol ether. Methanol was used as the primary coating solvent in place of the 50:50 methanol/methylethyl ketone used in Example 12. Various dispersing aids, wetting aids or surfactants including fluorinated surfactants, and optional adhesion-promoting additives were included in the coating solution. The weight percent composition of the solvent coating formulation is listed below:

| Component | Weight % (dry) | Weight % (wet) |
|---|---|---|
| colloidal $ZnSb_2O_6$ or $InSbO_4$ | 83.1 | 1.20 |
| binder (hydroxyethylcellulose) | 14.6 | 0.21 |
| dispersing aid | 0.8 | 0.012 |
| wetting aid (FLUORAD FC-431) | 1.4 | 0.020 |
| solvent(s) | 0 | (balance) |

The surface resistivities of the antistatic layers solvent-coated on top of magnetic layers were measured and the values given in Table 7. The optical and UV densities were also measured for the topically applied antistatic layers. The measured values were corrected for the densities of the magnetic layer and the undercoated PET support and are reported in Table 6 as "delta" densities. The present Examples demonstrate that conductive, transparent antistatic layers containing colloidal metal antimonate particles can be coated on top of magnetic layers using solvent-based coating formulations containing cellulosic binders. The antistatic layers also exhibit excellent adhesion to the underlying magnetic layers.

TABLE 7

| Example No. | Metal Antimonate | Total Dry Coverage ($g/m^2$) | Resist(logΩ/□) Surface (SER) Init | Resist(logΩ/□) Surface (SER) Post-Proc | Delta Density ($D_{min}$) UV | Delta Density ($D_{min}$) Ortho | Dry Adhesion |
|---|---|---|---|---|---|---|---|
| 14a | $ZnSb_2O_6$ | 0.3 | 8.8 | — | 0.039 | 0.008 | excellent |
| 14b | " | 0.4 | 9.1 | 9.7 | 0.025 | 0.007 | excellent |
| 14c | " | 0.5 | 9.0 | — | 0.034 | 0.009 | excellent |
| 14d | " | 0.6 | 8.9 | 9.3 | 0.026 | 0.005 | excellent |
| 14e | $InSbO_4$ | 0.3 | 9.8 | — | 0.013 | 0.008 | excellent |
| 14f | " | 0.4 | 9.5 | 9.8 | 0.020 | 0.009 | excellent |
| 14g | " | 0.5 | 9.3 | — | 0.022 | 0.010 | excellent |
| 14h | " | 0.6 | 9.3 | 9.7 | 0.025 | 0.010 | excellent |

The basic magnetic performance of the magnetic layers overcoated with antistatic layers was evaluated by measuring the magnetic hysteretic properties using a BH loop tracer as described in Example 13. No significant differences were observed after overcoating with the antistatic layers.

Example 15

An antistatic solvent-based coating formulation similar to that described in Example 12 was applied at a nominal total dry coverage of 0.5 $g/m^2$ to a support that had been previously coated with a transparent magnetic layer as described in Example 13. Colloidal metal antimonate compound I ($M^{+2}$=$Zn^{+2}$) was introduced into the coating solution as a 20% (w/w) dispersion in methanol. The binder was cellulose acetate. A mixture of dichloromethane and methanol was used as the primary coating solvent in place of the 50:50 methanol/methylethyl ketone used in Example 12. Various dispersing aids, wetting aids or surfactants including fluorinated surfactants were included in the coating solution. The weight percent composition of the solvent coating formulation is listed below:

| Component | Weight % (dry) | Weight % (wet) |
|---|---|---|
| colloidal $ZnSb_2O_6$ | 83.6 | 2.00 |
| binder (cellulose acetate) | 14.8 | 0.355 |
| dispersing aid | 0.8 | 0.020 |
| wetting aid (FLUORAD FC-431) | 0.8 | 0.020 |
| solvent(s) | 0 | (balance) |

The surface resistivity (SER) of the conductive layer was measured: 8.4 log Ω/□. The antistatic performance of an antistatic layer coated on top of the magnetic layer is not affected by photographic processing as demonstrated by the value for surface resistivity measured after processing: 8.6 log Ω/□. As was the case for Example 14, the dry adhesion of the antistatic layer of the present Example to the magnetic layer was excellent. The "delta" optical and UV densities were determined as in Example 13 as 0.011 and 0.039, respectively.

This Example demonstrates that an antistatic layer containing colloidal particles of metal antimonate compound I ($M^{+2}$=$Zn^{+2}$) dispersed with cellulosic binders in a mixed-solvent coating solution containing a chlorinated solvent can be coated on top of a magnetic layer without significant degradation of antistatic performance or transparency. Further, the basic magnetic performance of the magnetic layer was evaluated by measuring the magnetic hysteretic properties using a BH loop tracer as described in Example 13 and no significant differences were observed after overcoating with an antistatic layer.

Example 16

An aqueous antistatic coating formulation comprising colloidal particles of metal antimonate compound I ($M^{+2}$=$Zn^{+2}$) and gelatin as binder was applied to a polyethylene terephthalate support which had been previously undercoated with a terpolymer latex of acrylonitrile, vinylidene chloride, and acrylic acid (NVcC) as described in Example 1. The nominal total dry coverage was 0.25 g/m$^2$. The surface resistivity of the antistatic layer was measured at 50% R.H. as 8.6 log Ω/□. A transparent magnetic layer and optional lubricant layer described in Example 10 were coated onto the side of the support opposite the antistatic layer. The antistatic layer was overcoated with a thick layer containing antihalation dyes in gelatin binder at a nominal dry coverage of approximately 12 g/m$^2$. The internal resistivity of the overcoated antistatic layer was measured as 8.45 log Ω/□. The antistatic performance of the overcoated antistatic layer was not affected significantly by photographic processing as demonstrated by an internal resistivity (WER) measured after processing of 8.4 log Ω/□. The dry adhesion of the antihalation layer to the antistatic layer was excellent. Results obtained are summarized in Table 8 below.

Example 17

Antistatic subbing layers containing colloidal metal antimonate compound I ($M^{+2}$=$Zn^{+2}$) and gelatin as binder were prepared in a manner similar to that described in Example 1 except that the support was polyethylene naphthalate undercoated with a terpolymer latex of acrylonitrile, vinylidene chloride, and acrylic acid instead of polyethylene terephthalate. The weight percent composition of the aqueous coating formulation used to prepare the antistatic layers of the present example is listed below:

| Component | Weight % (dry) | Weight % (wet) |
|---|---|---|
| $ZnSb_2O_6$ | 89.4 | 1.8 |
| binder (gelatin) | 9.9 | 0.2 |
| hardener[(1)] | 0.2 | 0.004 |
| wetting aid (saponin) | 0.5 | 0.01 |
| water | 0.0 | (balance) |

[(1)]2,3-dihydroxy-1,4-dioxane

The coating formulation of this example was applied to the support at nominal dry coverages of 0.25, 0.35, 0.45, and 0.55 g/m$^2$. The surface resistivities of resulting antistatic layers were measured at 50% R.H. and the values listed in Table 8. The internal resistivities of the antistatic layers after overcoating with an antihalation layer were measured and the values reported in Table 8. The internal resistivities (WER) of antistatic layers also were measured after processing with commercial photographic processing solutions using the standard KODAK C-41 process. The values obtained also are shown in Table 8. The dry adhesion of the antistatic layer to both the support and antihalation layers was excellent. The present Example demonstrates that antistatic layers containing colloidal metal antimonate compounds also are conductive when coated on other support materials.

Example 18

Antistatic layers containing colloidal particles of metal antimonate compound I ($M^{+2}$=$Zn^{+2}$) and gelatin as binder were prepared at nominal dry coverages of 0.25, 0.35, 0.45, and 0.55 g/m$^2$ as described in Example 17. The support used in the present Example was not undercoated with a terpolymer latex of acrylonitrile, vinylidene chloride, and acrylic acid as in Example 17, but treated by glow discharge. Processes employing glow discharge treatment (GDT) and equipment for generating a glow discharge are well known and widely used in industry and any such process and equipment can be adapted for treatment of photographic supports. The surface resistivities of the antistatic layers were measured at 50% R.H. and the values listed in Table 8. The internal resistivities of the antistatic layers after overcoating with an antihalation layer were measured and the values reported in Table 8. The internal resistivities (WER) of antistatic layers also were measured after processing with commercial photographic processing solutions using the standard KODAK C-41 process. The values obtained also are shown in Table 8. The dry adhesion of the antistatic layer to both the glow discharge treated support and overlying antihalation layer was excellent.

TABLE 8

| Ex. No. | Support | Ucoat | Total Dry Coverage ($g/m^2$) | Resistivity ($\log\Omega/\square$) Surface (SER) | Internal(WER) Initial | Internal(WER) Post-Proc | Dry Adhesion |
|---|---|---|---|---|---|---|---|
| 16 | PET | NVcC | 0.25 | 8.6 | 8.4 | 8.4 | excellent |
| 17a | PEN | " | 0.35 | 7.8 | 7.6 | 9.4 | excellent |
| 17b | " | " | 0.45 | 7.4 | 7.2 | 8.6 | excellent |
| 17c | " | " | 0.55 | 7.2 | 7.1 | 8.1 | excellent |
| 18a | " | GDT | 0.25 | 8.8 | 9.2 | 10.4 | excellent |
| 18b | " | " | 0.35 | 7.6 | 7.4 | — | excellent |
| 18c | " | " | 0.45 | 7.3 | 7.1 | 8.2 | excellent |
| 18d | " | " | 0.55 | 7.0 | 7.0 | 7.8 | excellent |

As hereinabove described, the use of fine particles of an electronically-conductive metal antimonate to provide electrically-conductive layers in imaging elements overcomes many of the difficulties that have heretofore been encountered in the art. In particular, the use of fine particles of an electronically-conductive metal antimonate together with a suitable binder enables the preparation of electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact. Incorporation of a transparent magnetic layer in imaging elements containing the aforesaid electrically-conductive layer further enhances their usefulness.

In the practice of this invention, maximum antistatic protection is afforded by incorporating an electrically-conductive layer, comprising fine particles of an electronically-conductive metal antimonate, on both sides of the support. In this embodiment of the invention, the imaging element is provided with the first electrically-conductive layer and the image-forming layer on one side of the support and is provided with the second electrically-conductive layer, positioned either over or under the transparent magnetic layer, on the opposite side of the support.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, a transparent magnetic layer comprising magnetic particles dispersed in a film-forming binder and an electrically-conductive layer comprising a dispersion in a film-forming binder of fine particles of an electronically-conductive metal antimonate.

2. An imaging element as claimed in claim 1, wherein the coverage of magnetic particles in said transparent magnetic layer is in the range of from about 0.001 to about 10 $g/m^2$.

3. An imaging element as claimed in claim 1, wherein the coverage of magnetic particles in said transparent magentic layer is in the range of from about 0.01 to about 1 $g/m^2$.

4. An imaging element as claimed in claim 1, wherein said transparent magnetic layer overlies said electrically-conductive layer.

5. An imaging element as claimed in claim 1, wherein said electrically-conductive layer overlies said transparent magnetic layer.

6. An imaging element as claimed in claim 1, wherein said transparent magnetic layer and said electrically-conductive layer are on opposite sides of said support.

7. An imaging element as claimed in claim 1, wherein said transparent magnetic layer is interposed between image-forming layers.

8. An imaging element as claimed in claim 1, wherein said electrically-conductive layer is interposed between image-forming layers.

9. An imaging element as claimed in claim 1, wherein said transparent magnetic layer has a thickness in the range of from about 0.05 to about 10 micrometers.

10. An imaging element as claimed in claim 1, wherein said magnetic particles are cobalt-modified gamma-iron oxide particles.

11. An imaging element as claimed in claim 1, wherein the volume fraction of said metal antimonate particles is from about 20 to about 80% of the volume of said electrically-conductive layer.

12. An imaging element as claimed in claim 1 wherein the dry weight of said electrically-conductive layer is in the range of from about 0.1 to about 10 $g/m^2$.

13. An imaging element as claimed in claim 1, wherein said metal antimonate is of the formula $$M^{+2}Sb^{+5}{}_2O_6$$

wherein $M^{+2}$ is $Zn^{+2}$, $Ni^{+2}$, $Mg^{+2}$, $Fe^{+2}$, $Cu^{+2}$, $Mn^{+2}$ or $Co^{+2}$.

14. An imaging element as claimed in claim 1, wherein said metal antimonate is of the formula:

$$M^{+3}Sb^{+5}O_4$$

wherein $M^{+3}$ is $In^{+3}$, $Al^{+3}$, $Sc^{+3}$, $Cr^{+3}$, $Fe^{+3}$ or $Ga^{+3}$.

15. An imaging element as claimed in claim 1, wherein said metal antimonate has the formula $$ZnSb_2O_6.$$

16. An imaging element as claimed in claim 1, wherein said metal antimonate has the formula $$InSbO_4.$$

17. An imaging element as claimed in claim 1, wherein said support is a transparent polymeric film, said image-forming layer is comprised of silver halide grains dispersed in gelatin, said magnetic particles are cobalt-modified gamma-iron oxide particles, said film-forming binder in said electrically-conductive layer is gelatin, and said metal antimonate particles are colloidal particles of $ZnSb_2O_6$ or $InSbO_4$.

18. An imaging element as claimed in claim 1, wherein said support is a cellulose acetate film.

19. An imaging element as claimed in claim 1, wherein said support is a poly(ethylene terephthalate) film or a poly(ethylene naphthalate) film.

20. An imaging element as claimed in claim 1, wherein said support is a glow discharge treated support.

21. An imaging element as claimed in claim 1, wherein said film-forming binder in said electrically-conductive layer is a vinylidene chloride based terpolymer latex.

22. An imaging element as claimed in claim 1, wherein said film-forming binder in said electrically-conductive layer is a polymethylmethacrylate.

23. An imaging element as claimed in claim 1, wherein said film-forming binder in said electrically-conductive layer is hydroethylcellulose, cellulose diacetate or cellulose triacetate.

24. An imaging element as claimed in claim 1, wherein said film-forming binder in said electrically-conductive layer is a polyurethane.

25. An imaging element for use in an image-forming process, said imaging element comprising a support having on one side thereof an image-forming layer and a first electrically-conductive layer comprising a dispersion in a film-forming binder of fine particles of an electronically-conductive metal antimonate and having on the opposite side thereof a transparent magnetic layer comprising magnetic particles dispersed in a film-forming binder and a second electrically-conductive layer comprising a dispersion in a film-forming binder of fine particles of an electronically-conductive metal antimonate positioned either over or under said transparent magnetic layer.

26. An imaging element as claimed in claim 25, wherein said image-forming layer is a silver halide emulsion layer.

* * * * *